US005474246A

United States Patent [19]

Yamada

[11] Patent Number: 5,474,246

[45] Date of Patent: Dec. 12, 1995

[54] APPARATUS FOR CONTINUOUSLY TREATING A TAPE-LIKE ARTICLE

[75] Inventor: Yasuo Yamada, Toyama, Japan

[73] Assignee: Yoshida Kogyo K.K., Tokyo, Japan

[21] Appl. No.: 106,608

[22] Filed: Aug. 16, 1993

[30] Foreign Application Priority Data

Aug. 21, 1992 [JP] Japan ..... 4-222613

[51] Int. Cl.[6] ..... B65H 51/20

[52] U.S. Cl. ..... 242/364; 242/47.13; 242/411

[58] Field of Search ..... 242/47.13, 364.2, 242/147 R, 7.13, 364, 410, 411

[56] References Cited

U.S. PATENT DOCUMENTS

| | | | |
|---|---|---|---|
| 708,184 | 9/1902 | Weaver | 242/47.13 |
| 1,506,159 | 8/1924 | Brugger | 242/147 R |
| 1,682,453 | 8/1928 | Willheim | 242/47.13 |
| 1,795,923 | 3/1931 | Bidwell | 242/47.13 |
| 2,421,750 | 6/1947 | Gannett | 242/47.13 |
| 2,426,473 | 8/1947 | Straw | 242/147 R |
| 3,314,619 | 4/1967 | Kerstetter | 242/147 R |
| 4,026,484 | 5/1977 | Naegeli | 242/47.13 X |

FOREIGN PATENT DOCUMENTS

| | | | |
|---|---|---|---|
| 1117011 | 5/1956 | France . | |
| 41065 | 11/1956 | Germany | 242/7.13 |

*Primary Examiner*—Daniel P. Stodola
*Assistant Examiner*—Michael R. Mansen
*Attorney, Agent, or Firm*—Hill, Steadman & Simpson

[57] ABSTRACT

In an apparatus for continuously treating a tape-like article with various treatments while the tape-like article is introduced to one turning portion side of two or more endless belts, which are arranged along the circumference of revolution of a rotary framework at predetermined distances in parallel to a rotating shaft and revolve in one direction on the cylindrical surface of revolution, is wound polygon-spirally around the endless belts, and is discharged from the other turning portion side of the endless belts, the fluctuations in amount of feed of the tape-like article, which result from the polygonal shape, are absorbed at each of the introduction and discharge portions by a dancer roller operatively connected with a rotary cam having cam surfaces in conformity with the polygonal shape.

1 Claim, 4 Drawing Sheets

APPARATUS FOR CONTINUOUSLY TREATING A TAPE-LIKE ARTICLE

BACKGROUND OF THE INVENTION

1. Field of the Invention

This invention relates to an apparatus for continuously performing various treatments, such as drying, steam heating, washing and dyeing, over a tape-like article such as a surface fastener, a slide fastener chain or an ornamental ribbon efficiently and uniformly.

2. Description of the Related Art

An apparatus for drying starched yarns, which are wound spirally around an endless belt assembly of many endless belts arranged along the circumference of a rotary framework at predetermined distances in parallel to a rotating shaft of the rotary framework, while the starched yarns are running continuously from one turning end portion side to the other turning portion side of the endless belts of the endless belt assembly, is known as disclosed in, for example, Japanese Utility Model Publication NO. SHO 49-12844. According to this prior art dryer, through compact in size, it is possible to secure adequate drying time and to perform continuous drying in such a manner that the starched yarns are kept from overlapping one another.

Although it can be applied also to the treatment of the tape-like article, the prior art apparatus has not yet been of practical use for the following reasons.

In general, the treatment of a tape-like article does not terminate only in a single step, but in various steps. For example, a surface fastener tape, like a cloth product, is provided with various treatments, such as dyeing, steam heating, washing, drying and heat-setting. In addition, when stickiness is to be given to the back side of the surface fastener tape, it requires additional steps for continuously coating an adhesive agent to the back side of the surface fastener tape and then attaching a peel sheet to the coated surface. Generally a step of drying the adhesive agent is provided between the coating step and the peel-sheet attaching step.

Thus a tape-like article is processed with, in addition to the foregoing kinds of treatments, various treating steps. In order to guarantee the quality of a final product after these steps, it is most important to perform quality management for every step and, more particularly, exact tension adjustment of the running tape-like article. For example, when fluctuation in tension of the tape-like article is great in the drying step between the coating step and the peel-sheet attaching step, the coated surface would be wavy rather than smooth so that the peel sheet cannot be attached to the entire coated surface uniformly.

According to a yarn feeding mechanism of the drying apparatus disclosed in the above-mentioned publication, a yarn is wound spirally around the endless belt assembly of many endless belts arranged along the polygonal circumference of the rotary framework, while the yarn is running continuously from one turning portion side to the other turning portion side of the endless belts of the endless belt assembly. Therefore, unlike the case that the yarn is wound around a rotating cylindrical support surface, the amounts of fed yarn and discharged yarn vary time to time to cause great fluctuations in yarn tension. Conventionally, it has been customary to use a dancer roller in an effort to absorb such tension fluctuations; however, tension control merely using a dancer roller would not be effective in absorbing periodical and large tension fluctuations and hence would not follow the tension fluctuation of the yarn.

Meanwhile, tension control in various kinds of treatments of a tape-like article is fairly influential on the possible final product, and management of the tension would be severe as compared to the management of yarn tension. Though it has many advantages as mentioned above, the yarn feeding mechanism could not be put into practical use in an apparatus for providing a tape-like article with various treatments.

SUMMARY OF THE INVENTION

It is therefore an object of this invention to provide an apparatus for providing a tape-like article with various treatments using means for exactly absorbing tension fluctuations in the conventional feeding mechanism.

In order to accomplish the above object, as the result of various studies, the present inventors have focused on the polygonal running path which is a cause for tension fluctuations in the yarn feeding mechanism and acquired the construction of this invention.

According to this invention, there is provided an apparatus for continuously treating a tape-like article with various treatments while the tape-like article is introduced to one turning portion side of two or more endless belts which are arranged along the circumference of revolution of a rotary framework at predetermined distances in parallel to a rotating shaft and revolve in one direction on the cylindrical surface of revolution, is wound polygon-spirally around the endless belts, and is discharged from the other turning portion side of the endless belts, wherein the apparatus is equipped with synchronous absorbing means for absorbing fluctuations in amount of the conveyed tape-like article, which are due to the polygonal shaped running path of the tape-like article at the introduction portion and the discharge portion, in conformity with the polygonal shape.

Preferably, the synchronous absorbing means is a dancer roller operatively connected with a rotary cam for vertical movement or means for controlling the speed of a drive motor for the rotary framework using an inverter.

In the preferred embodiments in which the invention is applied to the production of surface fasteners, an adhesive agent is coated over the back surface of a surface fastener tape in a uniform thickness by an adhesive coating unit prior to introduction into the dryer. At that time, since the tension fluctuation of the surface fastener tape is suitably controlled according to the rotation rate (r.p.m.) of the rotary framework by the synchronous absorbing means, which constitutes the characterizing part of this invention, between the guide roller and the dryer, the thickness of coating layer of the adhesive agent on the back surface of the surface fastener tape would be kept from varying and so the surface fastener tape would be free from becoming wavy.

As it is wound spirally around the endless belt assembly supported on the rotary framework, the surface fastener tape introduced into the dryer is moved in the direction of rotation of the individual belt and is continuously discharged from the outlet port of the dryer via the guide roller. During that time, the adhesive agent is dried to such a degree as to maintain the adhesiveness. The surface fastener tape discharged from the dryer is then controlled in tension likewise by another synchronous absorbing means, which is situated adjacent to the outlet port and has the same structure as the above-mentioned synchronous absorbing means, whereupon the surface fastener tape is introduced into a peel sheet attaching unit where a peel sheet is attached to the adhesive-agent-coated surface of the surface fastener tape. Since the tension of the surface fastener tape being discharged from the rotary framework is controlled suitably by the synchronous absorbing means, the peel sheet can be attached uniformly to the whole surface of the adhesive-agent-coated surface without leaving any unattached area.

DETAILED DESCRIPTION

Figure 1:
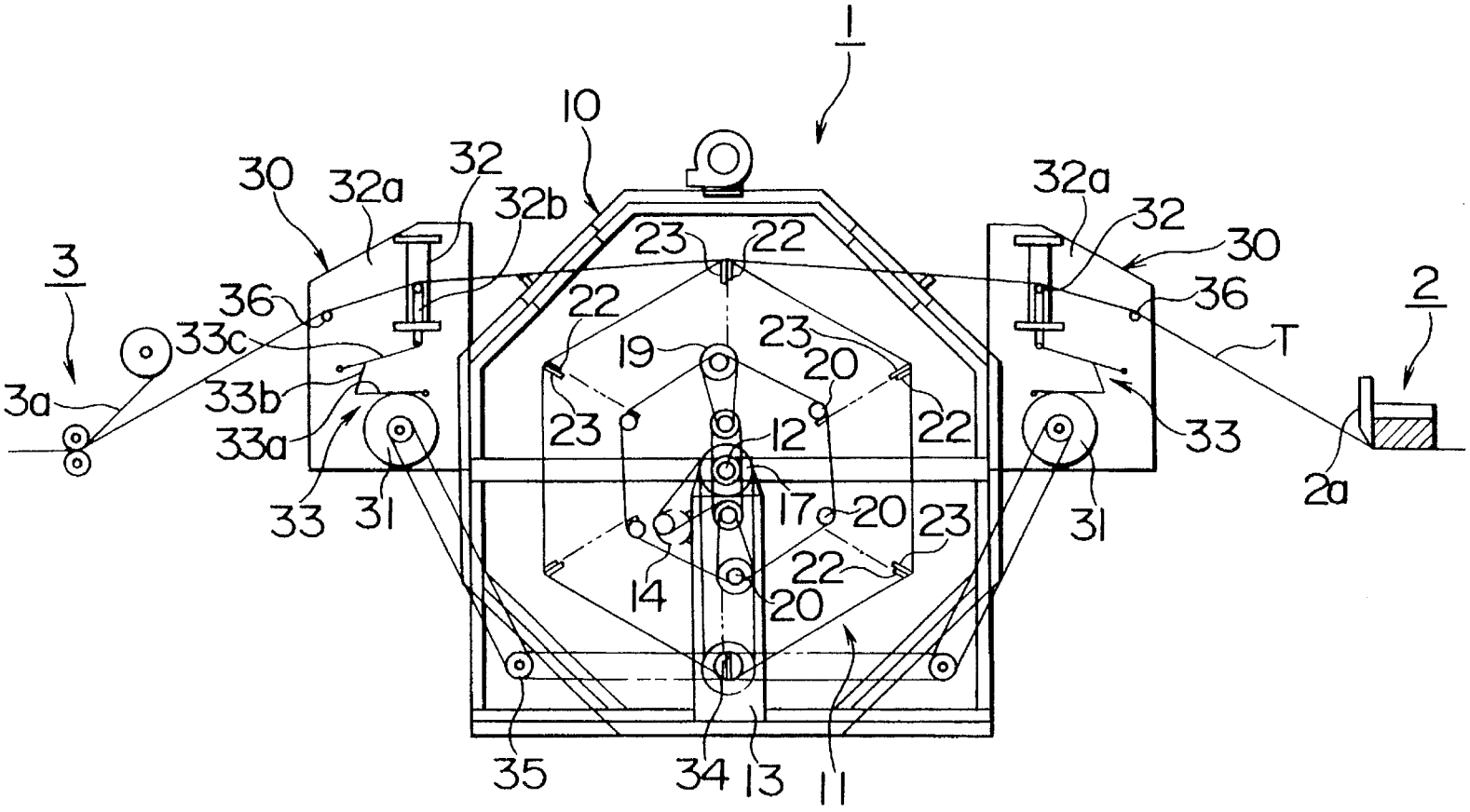
FIG. 1 is a schematic side view showing an apparatus, for manufacturing a surface fastener with one side coated with an adhesive agent, according to a typical embodiment of this invention.
Figure 2:
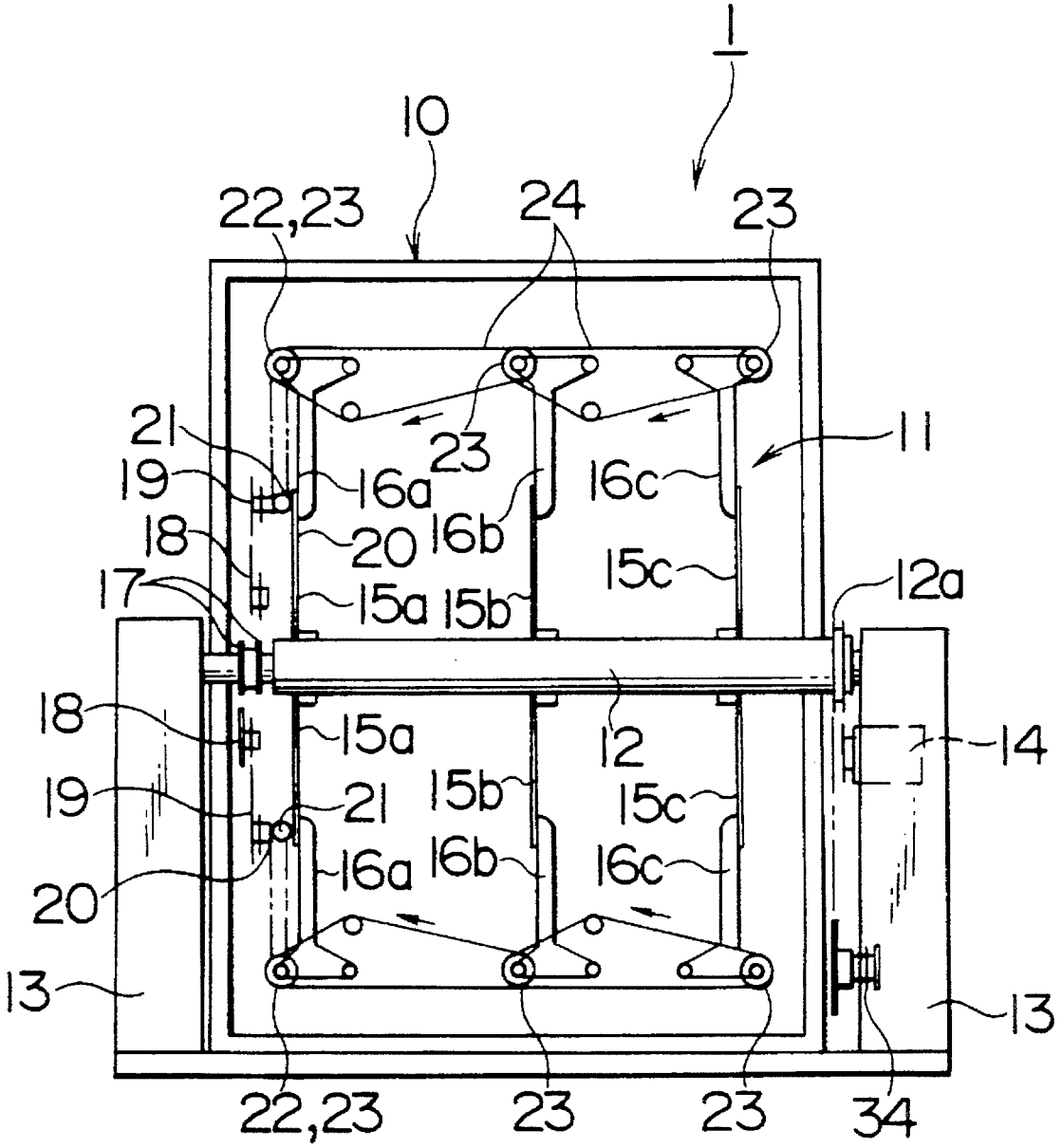
FIG. 2 is a front view of FIG. 1.

An embodiment in which this invention is applied to part of manufacturing steps of a surface fastener having an adhesive agent on its back surface will now be described in detail with reference to the accompanying drawings. FIG. 1 is a schematic side view showing the manufacturing step, FIG. 2 is a schematic front view of FIG. 1, and FIG. 3 is a diagram illustrating the operation and principle of this invention.

The operation of this invention will now be described in detail in connection with FIG. 3. FIG. 3 shows the change in amount of feed of a tape-like article T from one apex of a regular hexagonal frame-work, each side of which is 50 mm, to a predetermined position A, as the tape-like article T is wound around the framework being angularly moved by 60° at a pitch of 10°; reference characters a–f designate consecutive positions, respectively, of one apex of the framework. The fixed position A stands for the position in which a dancer roller 32 described below is situated; the dancer roller 32 is moved up and down with respect to a reference point O so as to absorb the change of amount of feed of the tape-like article T. Reference character B designates a fixed position in which a guide roller 36 serving as a synchronous absorbing means constituting the characterizing part of this invention is situated; the guide roller 36 guides the tape-like article T downwardly slantly from the reference point O in order to impart a predetermined tension to the tape-like article T at the reference point O.

Figure 3:
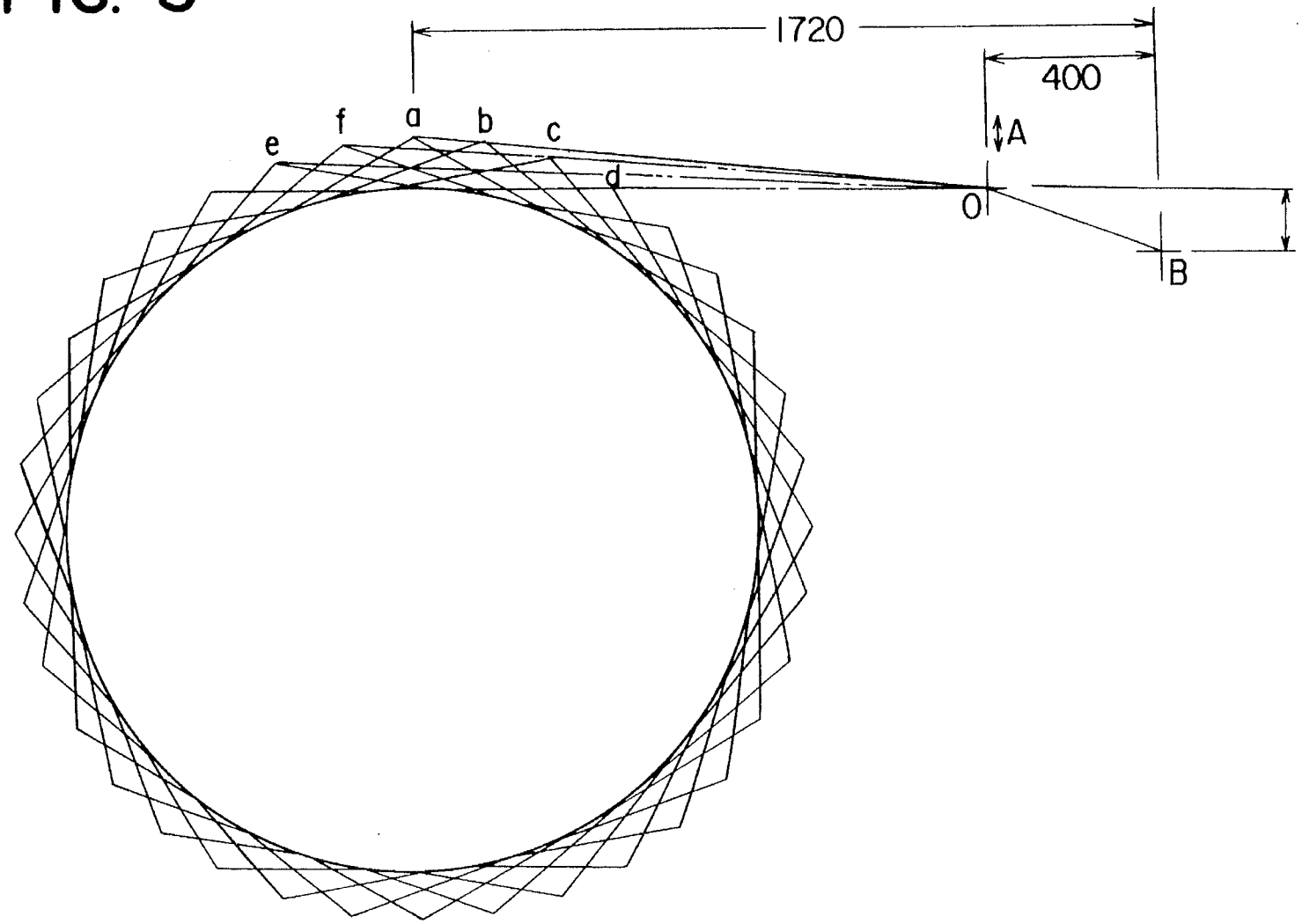
FIG. 3 is a diagram illustrating the operation and principle of this invention in connection with the illustrated example.
Figure 4:
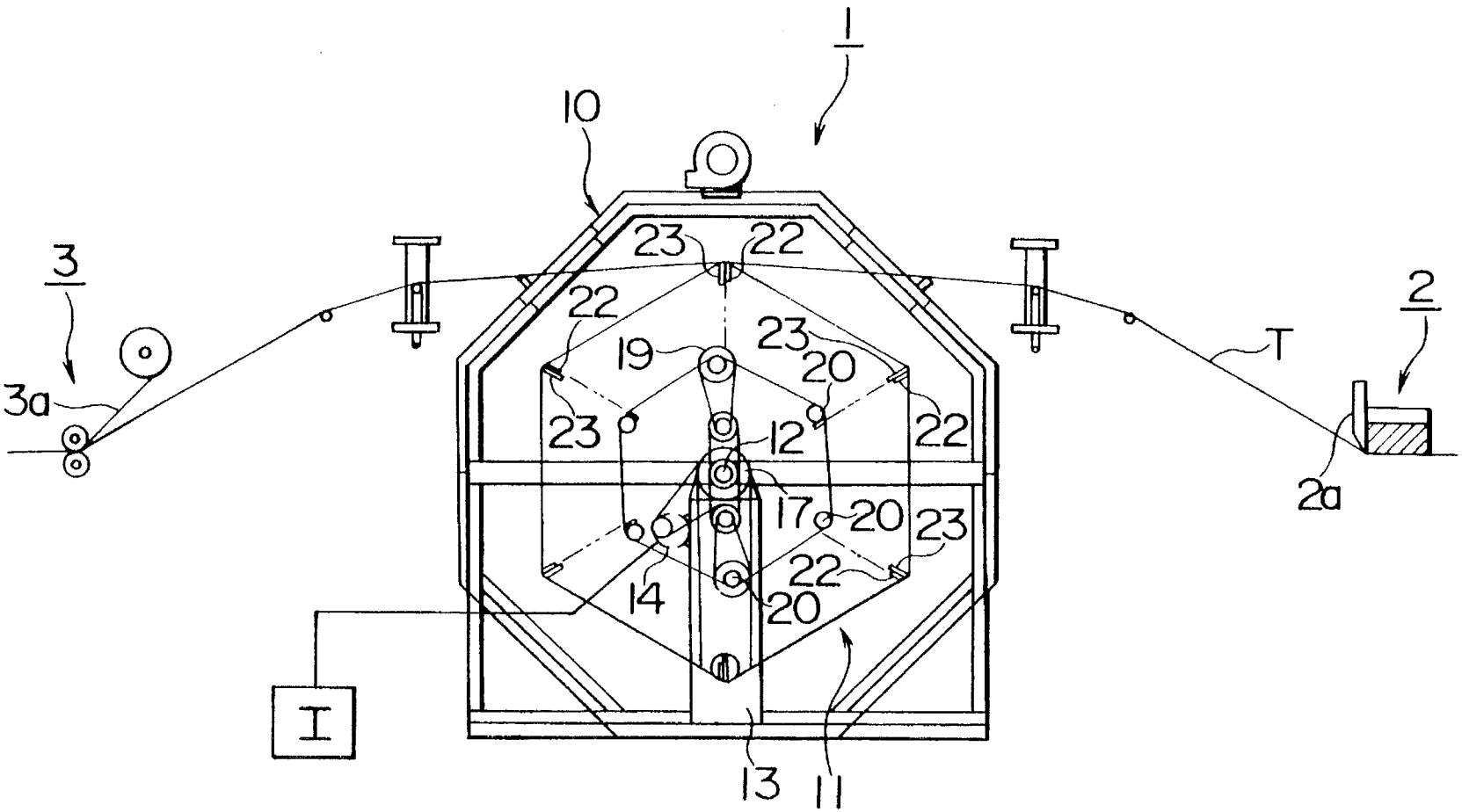
FIG. 4 is a schematic side view showing an alternate apparatus, for manufacturing a surface fastener.

According to the illustrated example of FIG. 3, a horizontal distance between the center of the rotary framework and the point B is 1720 mm; a horizontal distance between the point A and the point B is 400 mm; and a vertical distance between the point A and the point B is 150 mm, which is equal to the determined amount of the tape-like article to be fed every 10° of angular movement of the rotary framework (i.e., 900 mm for 60° of angular movement).

Table 1 shows experimental data, i.e. the length L-1 (mm) of the tape-like article from the apex to the point A, the actual amount of feed L-2 (mm) of the tape-like article every 10° of angular movement of the rotary framework, the differential value ΔL (mm) between the amount of feed L-2 and the preset vertical distance 150 mm between the point A and the point B, and the distance L-3 (mm) between upper and lower positions of the tape-like article at the point A with respect to the reference point O which is required in order to absorb the differential value ΔL, according to each angle of movement of the rotary framework when the tape-like article T is fed from the rotary framework under the foregoing conditions.

TABLE 1

| | L-1 | L-2 | ΔL | L-3 |
|---|---|---|---|---|
| a | 1325.5 | | | +17.5 |
| | | 156.9 | +6.9 | |
| b | 1168.6 | | | +24.0 |
| | | 154.2 | +4.2 | |
| c | 1014.4 | | | +14.0 |
| | | 144.4 | −5.6 | |
| d | 870.0 | | | −18.0 |
| | (1770.0) | 140.8 | −9.2 | |
| e | 1629.2 | | | −35.0 |
| | | 149.1 | −0.9 | |
| f | 1480.1 | | | −5.0 |
| | | 154.6 | +4.6 | |

As is apparent from Table 1, it is understood that the difference between the predetermined amount of feed of the tape-like article T and the actual amount of feed of the tape-like article T fluctuates sharply, depending on the angle of movement of the rotary framework. The fluctuation in amount of feed of the tape-like article directly results in fluctuation of tension of the tape-like article; but, this tension fluctuation can be absorbed by moving the point A upwardly and downwardly by the distance L-3, depending on the amount of fluctuation. In other words, by positively moving the dancer roller upwardly and downwardly depending on the angle of movement of the rotary framework like a first embodiment described below, it is possible to control the tension of the tape-like article even if the above-described starched yarn feeding mechanism is used. The illustrated embodiment is just an experimental example and so this invention should by no means be limited to this illustrated example.

The first embodiment of this invention will now be described in detail with reference to FIGS. 1 and 2. At upstream and downstream sides of a dryer 1, an adhesive agent coating unit 2 and a peel sheet attaching unit 3 are situated. Either the adhesive agent coating unit 2 and the peel sheet attaching unit 3 is of the type generally used in the art, and therefore their detailed description is omitted here for clarity.

Inside the dryer body 10 on which a suitable heating means such as an ultrared ray lamp and a hot air blower is mounted, a regular hexagonal rotary framework 11 is horizontally mounted. The opposite ends of a rotary shaft 12 of the framework 11 is rotatably supported by a support frame 13 situated outside the dryer body 10. The framework 11 is driven for rotation by an electric motor 14 fixedly mounted on the suport frame 13.

The framework 11 comprises three flanges 15*a*– 15*c* attached to the rotary shaft 12 at positions such as to longitudinally divide the rotating shaft 12 into substantially halves, and support levers 16*a*–16*c* extending radially from the respective flanges 15*a*–15*c*, each flange being supported at six equidistance circumferential positions. A chain wheel 17 is mounted on the rotary shaft 12 at an end opposite to the driven end. An intermediate chain wheel 18 is situated at such a position as to centrally confront the flange 15*a*. A reduction chain wheel 19 is attached to the attached base of the support lever 16*a* corresponding to the intermediate chain wheel 18 of the flange 15*a*. A first belt-driving chain wheel 20 is attached to the attached base of the respective support lever 16*a*. These chain wheels 17–20 rotate in a plane parallel to the surface of the flanges 15*a*–15*c*. A bevel gear is mounted on the attached base of the support lever 16*a* coaxially of the first belt-driving chain wheel 20, and a follower bevel gear, which is in mesh with the bevel gear, and a second belt-driving chain wheel 21 are attached to the attached base of the support lever 16*a*.

On the outer end of each support lever 16*a*, a third belt-driving chain wheel 22, which is to be driven by the second belt-driving chain wheel 21, and a belt driving wheel 23 are attached. Also on the outer end of each support lever 16*b*, 16*c*, a belt driving wheel 23 is attached. An endless belt 24 serving as a timing belt is wound on the respective belt driving wheel 23. The belt driving wheels 23 are arranged in a straight line parallel to the rotary shaft 12. Though there is not illustrated in the drawings, according to this embodiment, the endless belt 24 can be inclined in such a manner that one end comes toward the rotary shaft 12; by controlling the angle of inclination, it is possible to absorb the shrinkage of the tape-like article during the drying treatment. The construction of the dryer body 10 should by no means be limited to the illustrated example and, for example, the structure disclosed in the above-mentioned publication may be used.

In addition, a synchronous absorbing means 30 is situated outside either of inlet and outlet ports of the dryer body 10 for absorbing fluctuations of amount of feed of the tape-like article so as to meet with the polygonal running path. The synchronous absorbing means 30 includes a rotary cam 31, a dancer roller 32, and a linkage 33 for converting the change of the cam surface of the rotary cam 31 into upward and downward motions of the dancer roller 32.

The rotary cam 31 rotates in synchronism with the rotary framework 11 and, as shown in FIG. 2, a first intermediate chain wheel 34 for driving the rotary cam 31 is attached to the support frame 13, which supports the rotary shaft 12 of the framework 11, to transmit the rotation of a cam-driving chain wheel 12*a*, which is mounted on the rotary shaft 12, to the cam 31 via the first cam-driving intermediate chain wheel 34 and a second cam-driving second intermediate chain wheel 35. The opposite ends of the dancer roller 32 is supported on the upper end of a support lever 32*b* so as to move Up and down freely in a guide path defined vertically in a support frame 32*a*. A pivotal end of a dancer-roller actuation link 33*c* (described below) of the linkage 33 is pivotaly attached to the lower end of the support lever 32*b*. The linkage 33 is a toggle joint which converts a slight motion of the pivotal end of the link 33*a*, which pivotally moves about its one end in contact with the rotary cam surface, into an amplified motion of the pivotal end of the dancer-roller actuation link 33*c*, which is pivotally moves about its one end, via an intermediate link 33*b* to raise and lower the dancer roller 32 to a predetermined extent.

Though there is no illustration in the drawings, the cam surface of the rotary cam 31 is such that the dancer roller 32 is raised and lowered to a predetermined extent via the linkage 33 in order to absorb fluctuations in amount of feed of the tape-like article T which depend on the angle of movement of the rotary framework 11. In FIG. 1, reference numeral 36 designates a guide roller.

According to the illustrated embodiment, the surface fastener tape, which is the tape-like article T, is coated on its back surface with an adhesive agent in a uniform thickness by a blade 2*a* of the adhesive agent coating unit 2 before entering the dryer body 10. At that time, since fluctuations in tension of the tape-like article T is properly controlled to be commensurate to the angle of rotation of the framework 11 by the synchronous absorbing means 30, which is situated between the guide roller 36 and the dryer body 10 and constitutes the characterizing part of this invention, the tape-like article T will be free from fluctuation in thickness of the adhesive agent coated over the back surface and hence will be kept from becoming wavy.

After having been introduced into the dryer body 10, the tape-like article T is wound spirally around an assembly of endless belts 24, which is supported by the rotary framework 11 and is rotating in one way, while the tape-like article T is moved progressively in the direction of revolution of the assembly of endless belts 24. The tape-like article T is then continuously discharged from the outlet port of the dryer body 10 via the guide roller 36. During that time, the adhesive agent coated on the tape-like article T is dried to such a degree as to maintain the adhesiveness Then the tape-like article T discharged out of the dryer body 10 is controlled in tension, in the same manner as described above, via the synchronous absorbing means 30 near the outlet port of the dryer body 10, whereupon the tape-like article T is guided into the peel sheet attaching unit 3 where a peel sheet 3*a* is attached to the adhesive coated surface of the article T. Also at that time, since the tape-like article T paid out from the rotary framework 11 is controlled to a suitable tension by the synchronous absorbing means 30, a peel sheet 3*a* can be attached uniformly to the whole surface of the adhesive-agent-coated surface without leaving any unattached area.

This invention should by no means be limited to the illustrated dryer and may be also applied to apparatuses for providing a tape-like article T with other treatments. As a second embodiment, the synchronous absorbing means 30 may be substituted by an inverter for controlling the driving rate (r.p.m.) of the electric motor 14, which is a drive source for the rotary framework 11, to vary the amount of feed of the tape-like article T in synchronism with the angular movement of the framework 11, thus controlling the tension of the tape-like article T. Accordingly, various modifications may be suggested without departing from the gist of this invention.

As is apparent from the foregoing description, according to the tape-like article treating apparatus of this invention, since improvements are made to the conventional feeding mechanism, which could not be used in the tape-like article treating apparatus due to the great tension fluctuations caused by the polygonal shape of the rotary framework even though it has been regarded as a compact mechanism effective in feeding a starched yarn, it is possible to use the feeding mechanism in apparatuses for various treatments of a tape-like article, which requires strict management of the tension, thus guaranteeing high-quality products and making the apparatus compact in size as well as realizing high-speed treatment.

What is claimed is:

1. An apparatus for continuously treating a tape-like article with various treatments having a rotary framework, a rotating shaft and two or more endless belts, said rotary framework revolved by said rotating shaft, said endless belts arranged spaced apart on said rotary framework and oriented lengthwise in parallel to said rotating shaft and said endless belts arranged to circulate in one direction parallel to said rotating shaft, said endless belts arranged in a polygon pattern around the rotating shaft, said tape-like article introduced to a first position on said two or more endless belts and wound poligonspirally around outer surfaces of said endless belts, and discharged from a second position on the endless belts, said apparatus, comprising:

controlled synchronized absorbing means for absorbing fluctuations in feed rate of the conveyed tape-like article which are due to a polygonal shaped running path of the tape-like article defined by the outer surfaces of said endless belts; and wherein said synchronous absorbing means includes a dancer roller and a rotary cam, said dancer roller held against said tape-like article and mechanically connected to said rotary cam, said rotary cam having a surface configured to translate said dancer roller toward and away from said tape-like article as said cam rotates, rotation of said cam synchronized with the rotation of said rotary shaft.

* * * * *